US008891991B2

(12) United States Patent
Yoshioka et al.

(10) Patent No.: US 8,891,991 B2
(45) Date of Patent: Nov. 18, 2014

(54) DEVELOPING DEVICE AND IMAGE FORMING APPARATUS

(75) Inventors: Sakae Yoshioka, Kanagawa (JP); Shinichiro Fujimori, Kanagawa (JP); Masanori Kato, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 93 days.

(21) Appl. No.: 13/608,728

(22) Filed: Sep. 10, 2012

(65) Prior Publication Data

US 2013/0251414 A1 Sep. 26, 2013

(30) Foreign Application Priority Data

Mar. 23, 2012 (JP) ..... 2012-067113

(51) Int. Cl.
*G03G 15/20* (2006.01)

(52) U.S. Cl.
CPC ..... *G03G 15/2078* (2013.01); *G03G 15/2003* (2013.01)
USPC ..... 399/69; 399/229; 399/267; 399/282

(58) Field of Classification Search
CPC ..... G03G 15/20
USPC ..... 399/69
See application file for complete search history.

(56) References Cited

U.S. PATENT DOCUMENTS

| | | | | | |
|---|---|---|---|---|---|
| 3,937,181 | A * | 2/1976 | Handa | 399/269 |
| 4,015,561 | A * | 4/1977 | Howard et al. | 399/269 |
| 4,177,757 | A * | 12/1979 | Murakawa et al. | 399/269 |
| 4,226,525 | A * | 10/1980 | Sakamoto et al. | 399/29 |
| 4,500,198 | A * | 2/1985 | Daniels | 399/149 |
| 5,212,525 | A * | 5/1993 | Noami et al. | 399/276 |
| 5,768,666 | A * | 6/1998 | Ito et al. | 399/273 |
| 7,054,583 | B2 * | 5/2006 | Hirobe | 399/269 |
| 2004/0076454 | A1 | 4/2004 | Nishiyama | |
| 2008/0056747 | A1 * | 3/2008 | Miyoshi | 399/58 |
| 2013/0101320 | A1 * | 4/2013 | Okamoto et al. | 399/274 |
| 2013/0164042 | A1 * | 6/2013 | Watanabe et al. | 399/269 |
| 2013/0164043 | A1 * | 6/2013 | Watanabe | 399/269 |
| 2013/0195513 | A1 * | 8/2013 | Uehara | 399/269 |
| 2013/0202330 | A1 * | 8/2013 | Ochi et al. | 399/269 |
| 2013/0236215 | A1 * | 9/2013 | Ochi et al. | 399/269 |
| 2013/0302068 | A1 * | 11/2013 | Hirota et al. | 399/269 |
| 2013/0315635 | A1 * | 11/2013 | Funada et al. | 399/269 |
| 2014/0023408 | A1 * | 1/2014 | Kato et al. | 399/269 |

FOREIGN PATENT DOCUMENTS

| | | | | |
|---|---|---|---|---|
| JP | 2000-098749 | * | 4/2000 | G03G 15/09 |
| JP | 2000-098749 | A | 4/2000 | |
| JP | 2002-372868 | A | 12/2002 | |
| JP | 2007-206508 | A | 8/2007 | |
| JP | 2007-206508 | * | 9/2007 | G03G 15/09 |

* cited by examiner

*Primary Examiner* — Clayton E Laballe
*Assistant Examiner* — Kevin Butler
(74) *Attorney, Agent, or Firm* — Sughrue Mion, PLLC

(57) ABSTRACT

A developing device includes first and second magnet members respectively including first and second transfer magnetic poles that have different polarities, that generate a magnetic force for transferring a developer from a first developer-transporting member to a second developer-transporting member, and that are located at positions where the developer-transporting members come close to each other, wherein (B1×B2)/$L^2$ is less than about 400 where L represents a distance (mm) between an outer peripheral surface portion of the first developer-transporting member, the portion facing the first transfer magnetic pole, and an outer peripheral surface portion of the second developer-transporting member, the portion facing the second transfer magnetic pole, and B1 and B2 (mT) respectively represent maximum magnetic flux densities of the first and second transfer magnetic poles in a normal line direction on outer peripheral surfaces of the first and second developer-transporting members.

2 Claims, 9 Drawing Sheets

FIG. 8

| TEST No. | L (mm) | B1 (mT) | B2 (mT) | $(B1 \times B2)/L^2$ | EVALUATION RESULT (PRESENCE OR ABSENCE OF STRIPE) |
|---|---|---|---|---|---|
| 1 | 5 | 46 | 52 | 96 | (TRANSFER PATH IS NOT FORMED.) |
| 2 | 5 | 70 | 72 | 202 | (TRANSFER PATH IS NOT FORMED.) |
| 3 | 5 | 92 | 88 | 324 | ○ |
| 4 | 4 | 46 | 52 | 150 | (TRANSFER PATH IS NOT FORMED.) |
| 5 | 4 | 70 | 72 | 315 | ○ |
| 6 | 4 | 79 | 72 | 356 | △ |
| 7 | 4 | 92 | 88 | 506 | × |
| 8 | 3 | 46 | 52 | 266 | ○ |
| 9 | 3 | 92 | 72 | 736 | × |

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2012-067113 filed Mar. 23, 2012.

BACKGROUND (i) Technical Field

The present invention relates to a developing device and an image forming apparatus.

(ii) Related Art

An image forming apparatus, such as a printer, a copying machine, or a facsimile machine, to which an image recording system such as an electrophotographic system or an electrostatic recording system is applied includes a developing device that develops an electrostatic latent image formed on a latent image-carrying member, such as a photoconductor, with a developer.

An example of such a developing device includes plural developing rollers (e.g., two developing rollers) that hold a developer thereon with a magnetic force, the developer exhibiting magnetism, and that rotate and transport the developer to a developing region facing the latent image-carrying member so as to increase the development efficiency. Examples of the developer which exhibits magnetism include a two-component developer containing a non-magnetic toner and a magnetic carrier and a magnetic one-component developer. An example of the developing roller is a developer-holding-transporting member including a cylindrical transport member that rotates so as to hold a developer that exhibits magnetism and to transport the developer, and a magnetic member that generates a line of magnetic force for holding the developer with a magnetic force on the outer peripheral surface of the transport member and that is arranged in an inner space of the transport member in a fixed manner.

SUMMARY

According to an aspect of the invention, there is provided a developing device including a cylindrical first developer-transporting member having an outer peripheral surface for holding and transporting a developer that exhibits magnetism, the first developer-transporting member being arranged so as to rotate with a gap between the first developer-transporting member and a rotatable latent image-carrying member; a first magnet member in which plural magnetic poles extending in an axial direction of the first developer-transporting member are arranged at intervals in a rotation direction of the first developer-transporting member, the first magnet member being fixed in an inner space of the first developer-transporting member; a cylindrical second developer-transporting member having an outer peripheral surface for holding and transporting a developer that exhibits magnetism, the second developer-transporting member being arranged so as to rotate with gaps between the second developer-transporting member and the latent image-carrying member and between the second developer-transporting member and the outer peripheral surface of the first developer-transporting member; a second magnet member in which plural magnetic poles extending in an axial direction of the second developer-transporting member are arranged at intervals in a rotation direction of the second developer-transporting member, the second magnet member being fixed in an inner space of the second developer-transporting member; and a passage control member that controls a passage of a part of the developer held on the outer peripheral surface of the first developer-transporting member to maintain a particular amount of the developer transported, the passage control member being arranged with a gap between the passage control member and the outer peripheral surface of the first developer-transporting member and facing the outer peripheral surface of the first developer-transporting member in the axial direction of the first developer-transporting member, wherein the first magnet member and the second magnet member respectively include a first transfer magnetic pole and a second transfer magnetic pole that have different polarities and that generate a magnetic force functioning as a path for transferring the developer from the first developer-transporting member to the second developer-transporting member, the first transfer magnetic pole and the second transfer magnetic pole being located at positions corresponding to portions where the first developer-transporting member and the second developer-transporting member come close to each other, and $(B1 \times B2)/L^2$ is less than 400, or less than about 400, where L represents a distance (mm) between a first outer peripheral surface portion of the first developer-transporting member, the first outer peripheral surface portion facing the first transfer magnetic pole, and a second outer peripheral surface portion of the second developer-transporting member, the second outer peripheral surface portion facing the second transfer magnetic pole, B1 (mT) represents a maximum magnetic flux density of the first transfer magnetic pole in a normal line direction on the outer peripheral surface of the first developer-transporting member, and B2 (mT) represents a maximum magnetic flux density of the second transfer magnetic pole in a normal line direction on the outer peripheral surface of the second developer-transporting member.

BRIEF DESCRIPTION OF THE DRAWINGS

Exemplary embodiments of the present invention will be described in detail based on the following figures, wherein:

FIG. 8 is a table showing the results of an evaluation test;

DETAILED DESCRIPTION

Exemplary embodiments for carrying out the invention (hereinafter referred to as "exemplary embodiments") will now be described with reference to the attached drawings.

First Exemplary Embodiment

Figure 1:
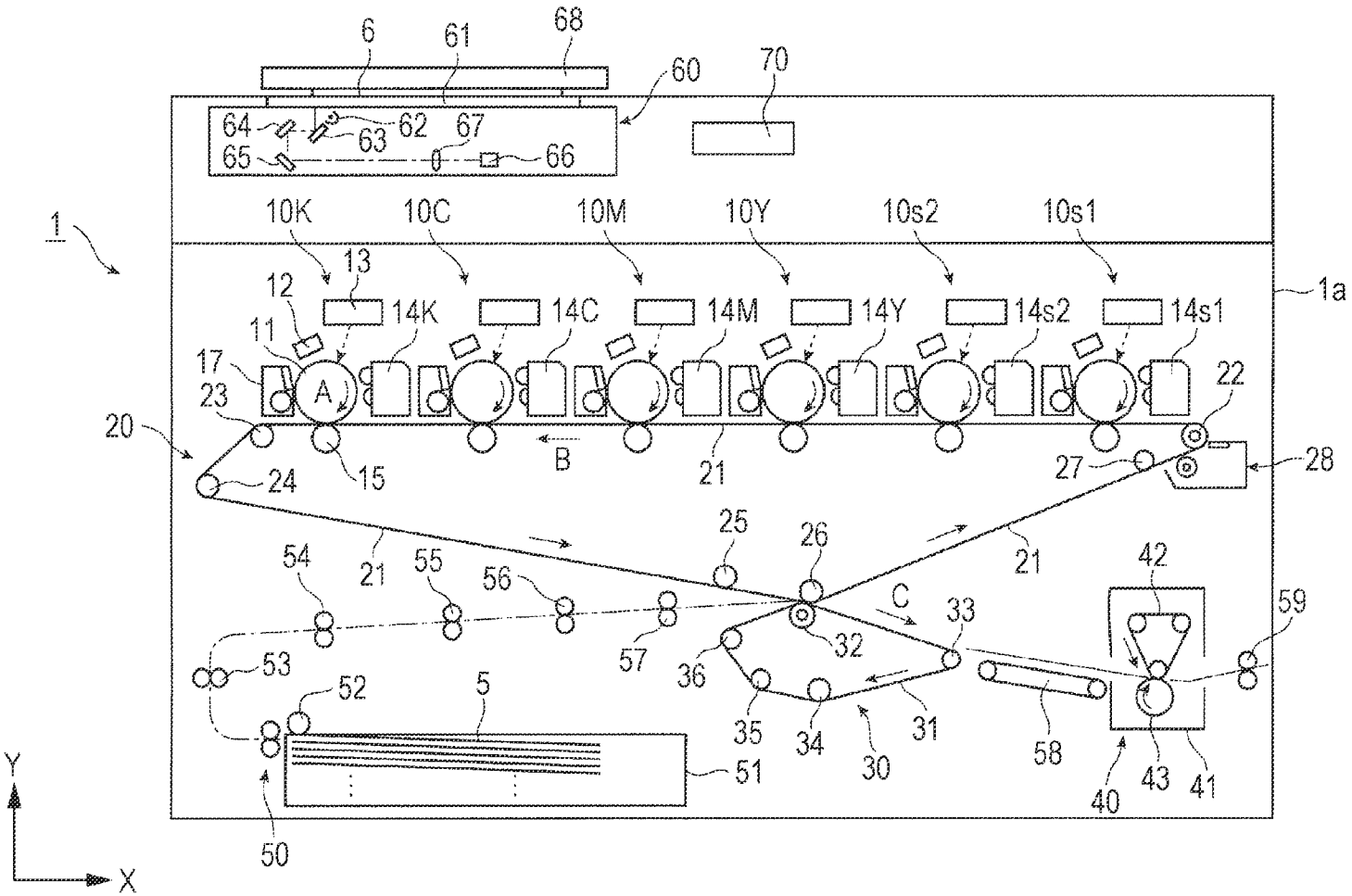
FIG. 1 is a view illustrating an image forming apparatus including a developing device according to a first exemplary embodiment.
Figure 2:
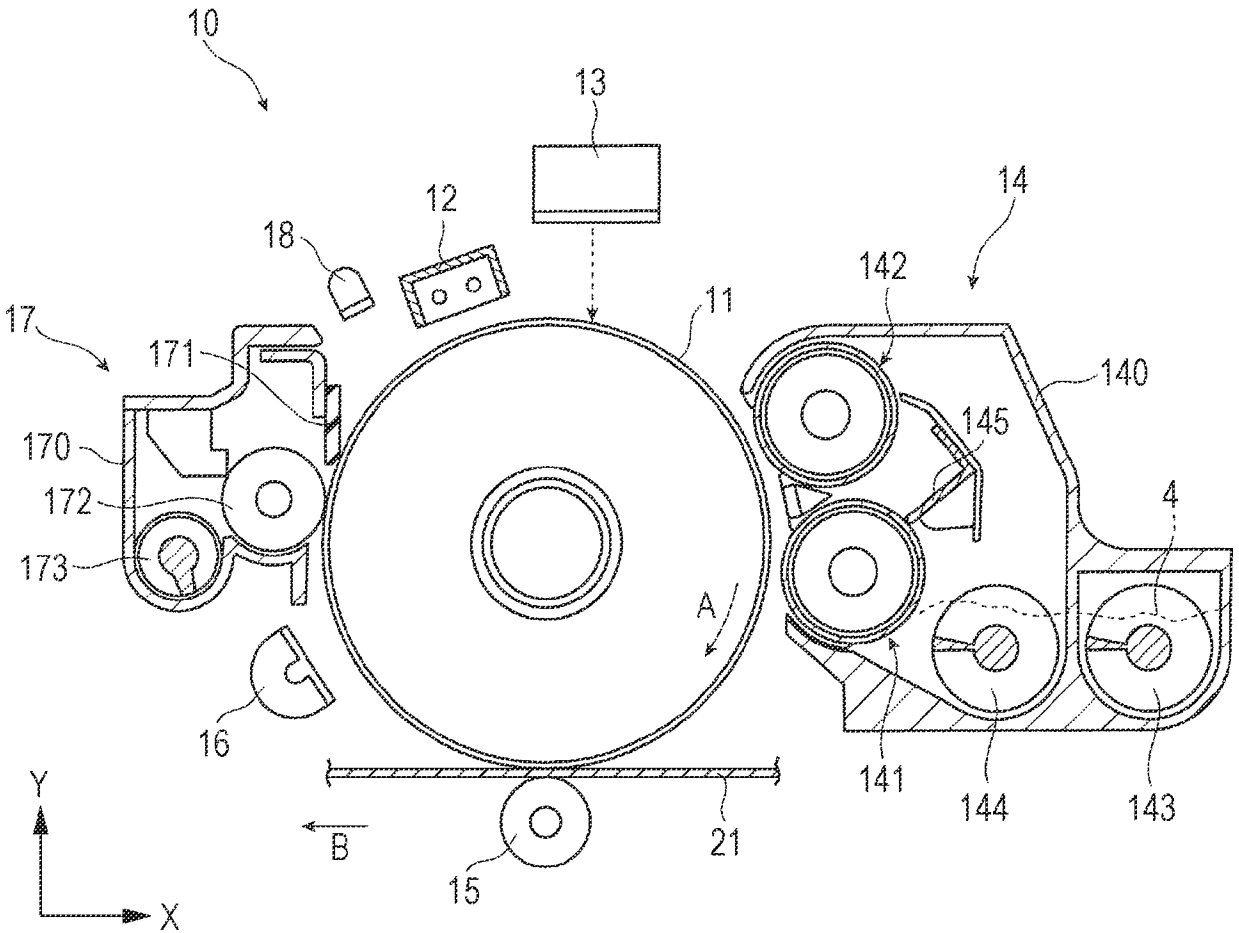
FIG. 2 is a partial cross-sectional view illustrating the relevant part (including an imaging device etc.) of the image forming apparatus illustrated in FIG. 1.

FIGS. 1 and 2 each illustrate an image forming apparatus according to a first exemplary embodiment. FIG. 1 is a view illustrating an overall structure of the image forming apparatus, and FIG. 2 is an enlarged view illustrating the relevant part (including an imaging device etc.) of the image forming apparatus.

Overall Structure of Image Forming Apparatus

An image forming apparatus 1 according to the first exemplary embodiment is configured as, for example, a color printer. The image forming apparatus 1 includes, for example, plural imaging devices 10, an intermediate transfer device 20, a paper feeding device 50, and a fixing device 40. Each of the imaging devices 10 forms a toner image developed with a toner contained in a developer 4. The intermediate transfer device 20 carries the respective toner images formed in the imaging devices 10 and transports the toner images to a secondary transfer position at which the toner images are finally secondarily transferred to recording paper 5 functioning as an example of a recording material. The paper feeding device 50 contains and transports the recording paper 5 to be supplied to the secondary transfer position of the intermediate transfer device 20. The fixing device 40 fixes the toner images that have been secondarily transferred to the recording paper 5 by the intermediate transfer device 20.

In the case where the image forming apparatus 1 additionally includes, for example, an image input device 60 that inputs a document image to be formed on the recording paper 5, the image forming apparatus 1 may be configured as a color copying machine. The image forming apparatus 1 includes a housing 1*a* including a supporting structural member, an exterior covering, etc. The alternate long and short dash line in the figure indicates a transport path through which the recording paper 5 is transported in the housing 1*a*.

Structure of Relevant Part of Image Forming Apparatus

The imaging devices 10 are six imaging devices 10Y, 10M, 10C, 10K, 10*s*1, and 10*s*2. The imaging devices 10Y, 10M, 10C, 10K exclusively form toner images of four colors of yellow (Y), magenta (M), cyan (C), and black (K), respectively. The imaging devices 10*s* and 10*s*2 exclusively form two toner images of special colors s1 and s2, respectively. These six imaging devices 10 (s1, s2, Y, M, C, and K) are arranged in a line in the internal space of the housing 1*a*. As the developers 4 (s1 and s2) for the special colors (s1 and s2), developers containing colorants of colors which are difficult or impossible to be expressed by the above four colors are used. Specific examples thereof include toners of colors other than the above four colors, toners having the same colors as the four colors and different chromas, transparent toners that improve the glossiness, foamable toners for Braille, and fluorescent color toners. These imaging devices 10 (s1, s2, Y, M, C, and K) have substantially common structure as described below except that the type of developer treated is different.

As illustrated in FIGS. 1 and 2, each of the imaging devices 10 (s1, s2, Y, M, C, and K) includes a rotatable photoconductor drum 11. For example, a charging device 12, an exposure device 13, a developing device 14, a primary transfer device 15, a pre-cleaning charging device 16, a drum cleaning device 17, and a charge erasing device 18 are arranged around the photoconductor drum 11. The charging device 12 charges a peripheral surface (image-carrying surface) of the photoconductor drum 11, on which an image is formed, to a certain potential. The exposure device 13 radiates light LB on the charged peripheral surface of the photoconductor drum 11 on the basis of image information (signal) to form an electrostatic latent image (for each color) having a potential difference. The developing device (s1, s2, Y, M, C, or K) develops the electrostatic latent image with a toner of a developer 4 of corresponding color (s1, s2, Y, M, C, or K) to form a toner image. The primary transfer device 15 transfers the toner image to the intermediate transfer device 20. The pre-cleaning charging device 16 charges adhering substances, such as a toner, which remains and adheres to the image-carrying surface of the photoconductor drum 11 after a primary transfer. The drum cleaning device 17 removes the recharged adhering substance to perform cleaning. The charge erasing device 18 erases charges on the image-carrying surface of the photoconductor drum 11 after cleaning.

The photoconductor drum 11 is obtained by forming an image-carrying surface having a photoconductive layer (photosensitive layer) composed of a photosensitive material on a peripheral surface of a cylindrical or columnar base to be subjected to a grounding treatment. This photoconductor drum 11 is supported so as to rotate in the direction indicated by the arrow A by the transmission of a motive power from a rotary driving device (not illustrated).

The charging device 12 is a non-contact type charging device, such as a corona discharge device, which is arranged without contacting the photoconductor drum 11. A voltage for charging is supplied to a discharge member of the charging device 12. In the case where the developing device 14 conducts reversal development, a voltage or current having the same polarity as the charging polarity of the toner supplied from the developing device 14 is supplied as the voltage for charging.

The exposure device 13 radiates light (the arrow indicated by the dotted line) LB formed in accordance with image information input to the image forming apparatus 1 onto the peripheral surface of the photoconductor drum 11 after the peripheral surface has been charged to form an electrostatic latent image. In forming a latent image, image information (signal) input to the image forming apparatus 1 by any method is transmitted to the exposure device 13.

As illustrated in FIG. 2, each of the developing devices 14 (s1, s2, Y, M, C, or K) includes, for example, a housing 140 having an opening and a chamber of the developer 4, and two developing rollers 141 and 142, two stirring-transporting members 143 and 144 such as screw augers, and a layer-thickness control member 145, all of which are arranged in the housing 140. The developing rollers 141 and 142 hold the developer 4 and transport the developer 4 to two development regions facing the photoconductor drum 11. The stirring-transporting members 143 and 144 transport the developer 4 so that the developer 4 is caused to pass through the developing rollers 141 and 142 while stirring the developer 4. The layer-thickness control member 145 controls the amount (layer thickness) of the developer held on the developing rollers 141 and 142. A voltage for development is supplied from a power supply unit (not illustrated) between the photoconductor drum 11 and the developing rollers 141 and 142 of the developing device 14. The developing rollers 141 and 142 and the stirring-transporting members 143 and 144 are rotated in predetermined directions by the transmission of a motive power from a rotary driving device (not illustrated). Two-component developers each containing a non-magnetic toner and a magnetic carrier are used as the developers 4 (Y, M, C, and K) for the four colors and the developers 4 (s1 and s2) for the two special colors.

The primary transfer device 15 is a contact-type transfer device that rotates in contact with the peripheral surface of the photoconductor drum 11 and that includes a primary transfer roller to which a voltage for the primary transfer is supplied. As the voltage for the primary transfer, a DC voltage having a polarity opposite to the charging polarity of the toner is supplied from the power supply unit (not illustrated).

As illustrated in FIG. 2, the drum cleaning device 17 includes, for example, a container-shaped body 170, a part of which is opened, a cleaning plate 171, a rotary brush roller 172, and a sending member 173 such as a screw auger. The cleaning plate 171 is arranged to contact with the peripheral surface of the photoconductor drum 11 after the primary transfer at a certain pressure, and removes adhering substances such as a residual toner to clean the peripheral surface of the photoconductor drum 11. The rotary brush roller 172 is arranged so as to rotate while contacting the peripheral surface of the photoconductor drum 11 on the upstream side of the cleaning plate 171 in the rotation direction of the photoconductor drum 11. The sending member 173 collects adhering substances such as a toner removed by the cleaning plate 171 and transports the adhering substances so as to send to a recovery system (not illustrated). The cleaning plate 171 may be a plate member (e.g., a blade) composed of rubber or the like.

As illustrated in FIG. 1, the intermediate transfer device 20 is arranged below the imaging devices 10 (s1, s2, Y, M, C, and K). The intermediate transfer device 20 includes an intermediate transfer belt 21, plural belt support rollers 22 to 27, a secondary transfer device 30, and a belt cleaning device 28. The intermediate transfer belt 21 rotates in the direction indicated by the arrow B while passing through primary transfer positions between the photoconductor drums 11 and the primary transfer devices 15 (primary transfer rollers). The belt support rollers 22 to 27 hold the intermediate transfer belt 21 from the inner surface thereof in a desired state to rotatably support the intermediate transfer belt 21. The secondary transfer device 30 is arranged on the outer peripheral surface (image-carrying surface) side of the intermediate transfer belt 21 supported by the belt support roller 26, and secondarily transfers the toner image on the intermediate transfer belt 21 to the recording paper 5. The belt cleaning device 28 removes adhering substances such as a toner and paper dust which remain and adhere to the outer peripheral surface of the intermediate transfer belt 21 after the intermediate transfer belt 21 passes through the secondary transfer device 30 to perform cleaning.

For example, the intermediate transfer belt 21 may be an endless belt composed of a material in which a resistance adjusting agent such as carbon black is dispersed in a synthetic resin such as a polyimide resin or a polyamide resin. The belt support roller 22 functions as a drive roller. The belt support rollers 23, 25, and 27 function as driven rollers that hold the running position or the like of the intermediate transfer belt 21. The belt support roller 24 functions as a tension-applying roller. The belt support roller 26 functions as a back-up roller of a secondary transfer.

As illustrated in FIG. 1, the secondary transfer device 30 includes a secondary transfer belt 31 and plural belt support rollers 32 to 36. The secondary transfer belt 31 rotates in the direction indicated by the arrow C while passing through a secondary transfer position which is an outer peripheral surface portion of the intermediate transfer belt 21 supported by the belt support roller 26 in the intermediate transfer device 20. The belt support rollers 32 to 36 hold the secondary transfer belt 31 from the inner surface thereof in a desired state to rotatably support the secondary transfer belt 31. For example, the secondary transfer belt 31 may be an endless belt having substantially the same structure as the above-described intermediate transfer belt 21. The belt support roller 32 is arranged so that the secondary transfer belt 31 is pressed with a certain pressure against the outer peripheral surface of the intermediate transfer belt 21 supported by the belt support roller 26. The belt support roller 32 functions as a drive roller, and the belt support roller 36 functions as a tension-applying roller. A DC voltage having a polarity opposite to or the same as the charging polarity of the toner is supplied as a voltage for the secondary transfer to the belt support roller 32 of the secondary transfer device 30 or the belt support roller 26 of the intermediate transfer device 20.

The fixing device 40 includes, for example, a housing 41 having an inlet and an outlet for the recording paper 5, and a heating rotary member 42 and a drum-shaped pressure rotary member 43 that are arranged in the housing 41. The heating rotary member 42 includes a fixing belt that rotates in the direction indicated by the arrow and that is heated by a heater so that the surface temperature thereof is maintained at a predetermined temperature. The pressure rotary member 43 is driven and rotated while contacting the heating rotary member 42 substantially along the axial direction of the heating rotary member 42 at a predetermined pressure. In this fixing device 40, a contact portion between the heating rotary member 42 and the pressure rotary member 43 functions as a fixing treatment portion where a fixing treatment (heating and pressing) is performed.

The paper feeding device 50 is arranged below the intermediate transfer device 20 and the secondary transfer device 30. The paper feeding device 50 includes at least one paper container 51 and a sending device 52. The paper container 51 contains a desired type of recording paper 5 having a desired size etc. in a stacked manner. The sending device 52 sends the recording paper 5 from the paper container 51 one by one. The paper container 51 is attached so as to be able to be drawn out to the front (a side surface toward which a user faces during operation) side of the housing 1*a*.

Paper transport roller pairs 53 to 57 that transport the recording paper 5 sent from the paper feeding device 50 to the secondary transfer position and a paper feed transport path formed by a transport guiding material (not illustrated) are arranged between the paper feeding device 50 and the secondary transfer device 30. The paper transport roller pair 57 arranged right before the secondary transfer position in the paper feed transport path function as, for example, rollers (resist rollers) that adjust the transport timing of the recording paper 5. A paper transport device 58 having, for example, a belt shape, is provided between the secondary transfer device 30 and the fixing device 40. The paper transport device 58 transports the recording paper 5 after the secondary transfer, the recording paper 5 being sent from the secondary transfer belt 31 of the secondary transfer device 30, to the fixing device 40. A paper discharge roller pair 59 is arranged near a paper outlet formed in the housing 1*a*. The paper discharge roller pair 59 discharges the recording paper 5 after fixing sent from the fixing device 40 to the outside of the housing 1*a*.

The image input device 60 installed in the case of a color copying machine is an image reading device that reads an image of a document having image information to be printed, and is arranged, for example, above the housing 1*a* as illustrated in FIG. 1. The image input device 60 includes a document placing plate (platen glass) 61, a light source 62, a reflection mirror 63, a first reflection mirror 64, a second reflection mirror 65, an image reading element 66, imaging lens 67, etc. The document placing plate 61 is composed of a transparent glass plate or the like, and a document 6 having information of an image to be read is placed on the document placing plate 61. The light source 62 illuminates the document 6 placed on the document placing plate 61 while moving. The reflection mirror 63 receives light reflected from the document 6 while moving together with the light source 63 and reflects the light in a predetermined direction. The first reflection mirror 64 and the second reflection mirror 65 move a predetermined distance at a predetermined speed with respect to the reflection mirror 63. The image reading element 66 may be a charge coupled device (CCD) or the like that receives and reads light reflected from the document 6 and converts the light into an electrical signal. The imaging lens 67 focuses the reflected light on the mage reading element 66. An opening/closing cover 68 covers the document placing plate 61.

The image information of the document read and input by the image input device 60 is subjected to necessary image processing by an image processing device 70. First, in the image input device 60, the image information of the read document is transmitted to the image processing device 70 as, for example, image data (e.g., each 8-bit data) of three colors of red (R), green (G), and blue (B). The image processing device 70 performs predetermined image processing such as shading correction, misregistration correction, brightness/color space conversion, gamma correction, frame erasing, color/movement edition, etc. on the image data transmitted from the image input device 60. The image processing device 70 changes image signals after the image processing to respective image signals of the four colors (Y, M, C, and K) and then transmits the image signals to the exposure device 13. The image processing device 70 also generates image signals for the two special colors (s1 and s2).

Operation of Entire Part and Relevant Part of Image Forming Apparatus

A basic image forming operation of the image forming apparatus 1 will now be described.

First, a description will be made of, as a typical example, an image forming operation in the case where a full-color image is formed by combining toner images of four colors (Y, M, C, and K) using the four imaging devices 10 (Y, M, C, and K).

When the image forming apparatus 1 receives instruction information of a demand for an image forming operation (printing), the four imaging devices 10 (Y, M, C, and K), the intermediate transfer device 20, the secondary transfer device 30, the fixing device 40, etc. start to operate.

In each of the imaging devices 10 (Y, M, C, and K), first, the photoconductor drum 11 rotates in the direction indicated by the arrow A, and the charging device 12 charges the surface of the photoconductor drum 11 with a predetermined polarity (negative polarity in the first exemplary embodiment) and potential. Subsequently, the exposure device 13 radiates light LB on the surface of the photoconductor drum 11 after charging, the light LB being emitted on the basis of image signals obtained by converting information of images input to the image forming apparatus 1 to respective color components (Y, M, C, and K), to form, on the surface, an electrostatic latent image of each color component having a certain potential difference.

Subsequently, each of the developing devices 14 (Y, M, C, and K) supplies a toner of a corresponding color (Y, M, C, or K) charged with the predetermined polarity (negative polarity) from the developing rollers 141 and 142 to the electrostatic latent image of each color component formed on the photoconductor drum 11, and causes the toner to electrostatically adhere, thus conducting development. The electrostatic latent images of respective color components formed on the photoconductor drums 11 are visualized by this development as toner images of the four colors (Y, M, C, and K) developed with the toners of corresponding colors.

Subsequently, when the toner images of the respective colors formed on the photoconductor drums 11 of the imaging devices 10 (Y, M, C, and K) are transported to primary transfer positions, the primary transfer devices 15 primarily transfer the toner images of respective colors so that the toner images are sequentially overlapped with respect to the intermediate transfer belt 21 rotating in the direction indicated by the arrow B of the intermediate transfer device 20.

In each of the imaging devices 10 after the primary transfer is finished, the pre-cleaning charging device 16 recharges adhering substances such as a toner remaining on the surface of the photoconductor drum 11 after the primary transfer. The drum cleaning device 17 removes the recharged adhering substances so as to scrape the adhering substances to clean the surface of the photoconductor drum 11. Lastly, the charge erasing device 18 erases charges on the surface of the photoconductor drum 11 after cleaning. Thus, the imaging devices 10 are prepared so that the next imaging operation is performed.

Subsequently, in the intermediate transfer device 20, the toner images that have been subjected to the primary transfer are held and transported to the secondary transfer position by the rotation of the intermediate transfer belt 21. In the paper feeding device 50, the recording paper 5 is sent to the paper feed transport path in accordance with the imaging operation. In the paper feed transport path, the paper transport roller pair 57 functioning as resist rollers sends and supplies the recording paper 5 to the secondary transfer position in accordance with the transfer timing.

At the secondary transfer position, the secondary transfer device 30 secondarily transfers the toner images on the intermediate transfer belt 21 to the recording paper 5 at one time. In the intermediate transfer device 20 after the secondary transfer is finished, the belt cleaning device 28 removes adhering substances such as a toner remaining on the surface of the intermediate transfer belt 21 after the secondary transfer to clean the intermediate transfer belt 21.

Subsequently, the recording paper 5 on which the toner images are secondarily transferred is separated from the intermediate transfer belt 21 and the secondary transfer belt 31, and is then transported to the fixing device 40 by the paper transport device 58. In the fixing device 40, the recording paper 5 after the secondary transfer is introduced in and caused to pass through the contact portion between the rotatable heating rotary member 42 and pressure rotary member 43, whereby performing a fixing treatment (heating and pressing). Thus, unfixed toner is fixed to the recording paper 5. Lastly, in the case of an image forming operation for forming an image only on a single side of the recording paper 5, the recording paper 5 after fixing is discharged by the paper discharge roller pair 59 to, for example, a discharge container (not illustrated) installed outside the housing 1*a*.

The recording paper 5 on which a full-color image is formed by combining toner images of the four colors is output through the above operation.

Next, a description will be made of an operation in the case where special color toner images formed by the developers for the special colors s1 and s2 are formed in combination with, for example, the above-described typical image formation in the image forming apparatus 1.

In this case, first, an imaging operation is conducted in each of the imaging devices 10*s*1 and 10*s*2 as in the case of the imaging devices 10 (Y, M, C, and K). Thus, toner images (s1 and s2) of the special colors are respectively formed on the photoconductor drums 11 in the imaging devices 10*s*1 and 10*s*2. Subsequently, as in the case of the image forming operation related to the toner images of the four colors, the toner images of the special colors formed in the imaging devices 10*s*1 and 10*s*2 are primarily transferred to the intermediate transfer belt 21 of the intermediate transfer device 20, and then secondarily transferred from the intermediate transfer belt 21 to the recording paper 5 (together with the toner images of the other colors) by the secondary transfer device 30. Lastly, the recording paper 5 to which the toner images of the special colors and the toner images of the other colors have been secondarily transferred is subjected to a fixing treatment in the fixing device 40, and then discharged to the outside of the housing 1*a*.

Through the above operation, the recording paper 5 on which the two toner images of the special colors are overlapped over the entire surface or on a part of the full-color image formed by combining the toner images of the four colors is output.

Furthermore, in the case where the image forming apparatus 1 is a color copying machine including the image input device 60, a basic image forming operation of the image forming apparatus 1 is performed as follows.

Specifically, in this case, when the document 6 is set on the image input device 60 and the image forming apparatus 1 receives instruction information of a demand for an image forming operation (copying), a document image of the document 6 is read in the image input device 60. The information of the read document image is then subjected to the image processing in the image processing device 70 as described above, and generated as signals of the image. Subsequently, the signals of the image are transmitted to the exposure device 13 in each of the imaging devices 10 (s1, s2, Y, M, C, and K). Thus, in each of the imaging devices 10, the formation of an electrostatic latent image and the formation of a toner image are performed on the basis of the image information of the document 6. Thereafter, the same operation as in the case of the image forming operation (printing) is performed. Lastly, an image corresponding to the toner images is formed on the recording paper 5, and output.

Detailed Structure of Relevant Part of Image Forming Apparatus

Next, the relevant part (including the developing device in the imaging device) of the image forming apparatus 1 will be described in detail.

Detailed Structure of Developing Device

First, the structure of the developing devices 14 will be described in detail.

Figure 3:
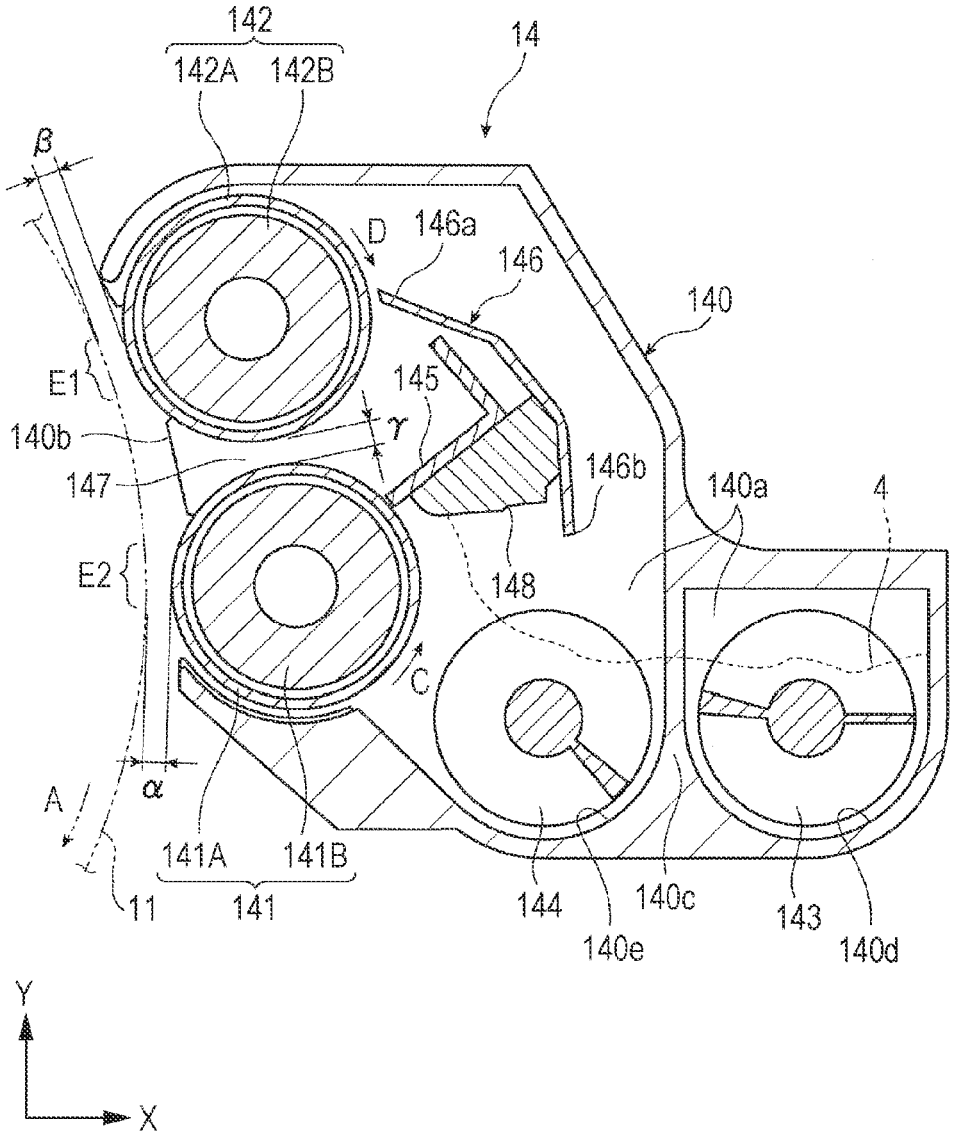
FIG. 3 is a schematic cross-sectional view illustrating the developing device used in the image forming apparatus illustrated in FIG. 1.
Figure 4:
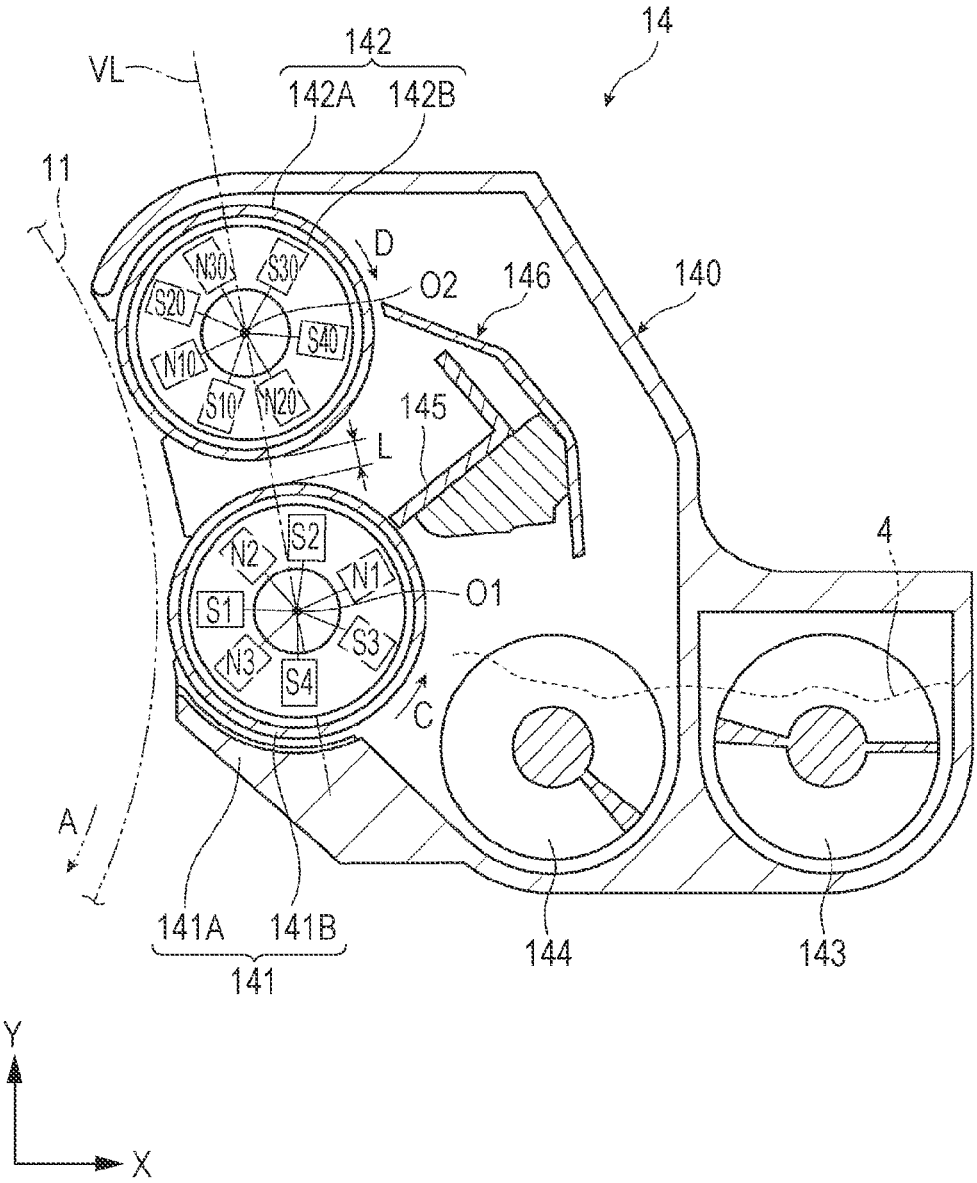
FIG. 4 is a schematic view that illustrates in detail magnetic poles etc. of the developing device illustrated in FIG. 3.

As illustrated in FIGS. 2 to 4 etc., the developing device 14 includes a housing 140 having a storage chamber 140*a* that stores the two-component developer 4 and a rectangular opening 140*b* formed at a position facing the photoconductor drum 11. This housing 140 has a long container-like shape having a length longer than the length of the photoconductor drum 11 in the axial direction. The storage chamber 140*a* is formed so that a bottom portion of the storage chamber 140*a* has two developer circulating transport paths (groove portions) 140*d* and 140*e* extending in parallel. Specifically, the developer circulating transport paths 140*d* and 140*e* are connected to each other at both ends in the longitudinal direction of the long container-like shape, and a central portion between the transport paths 140*d* and 140*e* is partitioned by a partition protrusion extending in the longitudinal direction. The two-component developer 4 is contained in this storage chamber 140*a*.

As illustrated in FIG. 3 etc., in the developing device 14, two developing rollers 141 and 142 (hereinafter also referred to as "first developing roller 141" and "second developing roller 142"), two screw augers 143 and 144, a passage control plate 145, a recovery guiding plate 146, etc. are arranged in the housing 140. The developing rollers 141 and 142 transport the developer 4 to developing regions E2 and E1, respectively, facing the photoconductor drum 11 at two positions while holding the developer 4 thereon with a magnetic force. The screw augers 143 and 144 function as stirring-transporting members that stir and transport the developer 4 contained in the storage chamber 140*a*. The passage control plate 145 controls the passage of the developer 4 supplied from the screw auger 144 to the first developing roller 141 to control the thickness of the layer of the developer 4 (the amount of developer transported). The recovery guiding plate 146 guides the developer 4 separated from the second developing roller 142 so as to return the developer 4 to the storage chamber 140*a*.

The first developing roller 141 and the second developing roller 142 are arranged so as to rotate in predetermined directions C and D, respectively, in a state where a part of each of the developing rollers 141 and 142 is exposed through the opening 140*b* of the housing 140. The two developing rollers 141 and 142 are arranged with a certain gap γ therebetween in the rotation direction A of the photoconductor drum 11. A portion (space) where the developing rollers 141 and 142 are closest to each other is formed as a closest portion 147.

The first developing roller 141 includes a cylindrical sleeve 141A and a magnet roller 141B. The sleeve 141A is supported so as to rotate in the direction of the arrow C with there being a certain distance a between itself and the downstream developing region E2 of the outer peripheral surface of the photoconductor drum 11. The magnet roller 141B is provided so as to be fixed inside the sleeve 141A. The rotation direction C of the sleeve 141A is determined so that the moving direction of the sleeve 141A in the downstream developing region E2 of the photoconductor drum 11 is the same as the rotation (moving) direction A of the photoconductor drum 11.

The second developing roller 142 includes a cylindrical sleeve 142A and a magnet roller 142B. The sleeve 142A is supported so as to rotate in the direction of the arrow D with there being a certain distance β between itself and the upstream developing region E1 of the outer peripheral surface of the photoconductor drum 11, the upstream developing region E1 being located on the upstream side of the downstream developing region E2. The magnet roller 142B is provided so as to be fixed inside the sleeve 142A. The rotation direction D of the sleeve 142A is determined so that the moving direction of the sleeve 142A in the upstream developing region E1 of the photoconductor drum 11 is opposite to the rotation (moving) direction A of the photoconductor drum 11.

Each of the sleeves 141A and 142A is composed of a non-magnetic material (such as stainless steel or aluminum), and at least includes a cylindrical portion having a width (length) substantially the same as an image forming effective region in the axial direction of the rotation of the photoconductor drum 11. The sleeves 141A and 142A are each arranged so that the axial direction of the rotation thereof is substantially parallel to the axial direction of the rotation of the photoconductor drum 11. In addition, both ends of each of the sleeves 141A and 142A are formed as shaft portions. A distance-holding ring (tracking roll) (not illustrated) that is larger than the outer peripheral surface of the sleeve by the dimension of the distance a or β is attached to each of the ends. The sleeves 141A and 142A are each rotatably bearing-supported with respect to side surface portions of the housing 140 so that the sleeves 141A and 142A rotate while the distance-holding ring is pressed on the outer peripheral surface of the photoconductor drum 11 with a certain pressure.

The sleeves 141A and 142A receive a necessary rotational motive power from a rotary driving device or the like (not illustrated) at an end of the respective shaft portions thereof and are rotated in the directions indicated by the arrows C and D, respectively. Furthermore, a developing voltage for forming a developing electric field is applied from a power supply device (not illustrated) between the photoconductor drum 11 and each of the sleeves 141A and 142A. For example, a DC voltage on which an AC component is superimposed is applied as the developing voltage.

Each of the magnet rollers 141B and 142B has a structure in which plural magnetic poles (S-pole and N-pole) are arranged. The magnetic poles generate lines of magnetic force or the like with which a magnetic carrier in the developer 4 is held on the outer peripheral surfaces of the sleeves 141A and 142A while forming magnetic brushes (carrier chains). For example, the magnet rollers 141B and 142B are attached so that both ends of each of the magnet rollers 141B and 142B are fixed to side surface portions of the housing 140 through inner spaces in the shaft portions of the sleeves 141A and 142A. The magnetic poles each extend in the axial directions of the sleeves 141A and 142A, and arranged at predetermined positions at intervals in the circumferential directions (rotation directions) of the sleeves 141A and 142A.

Each of the screw augers 143 and 144 has a structure in which a transport blade is wound around a peripheral surface of a rotary shaft in a spiral manner. As illustrated in FIG. 3 etc., the screw augers 143 and 144 are rotatably arranged in the two developer circulating transport paths 140*d* and 140*e*, respectively, formed with a partition wall therebetween in the storage chamber 140*a* of the housing 140, and rotate in a direction in which the developer 4 present in each of the circulating transport paths 140*d* and 140*e* is transported in a predetermined direction. A part of a motive power for rotating each of the sleeves 141A and 142A in the developing rollers 141 and 142 is branched by a drive transmission mechanism such as a gear and transmitted to the screw augers 143 and 144, whereby the screw augers 143 and 144 are rotated. The screw auger 144 arranged at a position close to the first developing roller 141 transports the developer 4 and supplies a part of the developer 4 to the first developing roller 141.

As illustrated in FIG. 3 etc., the passage control plate 145 is a rectangular plate having at least a length (long side) equal to the length of the sleeve 141A of the first developing roller 141 in the axial direction, and has a portion having a substantially uniform thickness. The passage control plate 145 is composed of a non-magnetic material such as stainless steel. Furthermore, the passage control plate 145 is attached to a support 148 of the housing 140 so that one end in the longitudinal direction (a lower long-side portion) of the passage control plate 145 in cross-sectional view faces the outer peripheral surface of the sleeve 141A with a certain distance (control distance) therebetween and the passage control plate 145 extends in the axial direction of the sleeve 141A and faces the sleeve 141A. The passage control plate 145 in the first exemplary embodiment is a plate having a shape in which the other end is bent so that the entire cross section has an L-shape.

The recovery guiding plate 146 is a plate having a surface that receives developer separated from the second developing roller 142 and then allows the developer to slide and drop so as to return the developer to the storage chamber 140*a*. As illustrated in FIG. 3 etc., the recovery guiding plate 146 is attached to the support 148 so that an upper end portion 146*a* of the recovery guiding plate 146 faces the outer peripheral surface of the sleeve 142A at a position between magnetic poles S30 and S40 described below, which are separation poles of the second developing roller 142, with a predetermined distance therebetween and a lower end portion 146*b* thereof gradually extends from the upper end portion 146*a* toward the lower side and reaches a position close to the upper portion of the screw auger 144.

As illustrated in FIG. 4 etc., the magnet roller 141B of the first developing roller 141 in the developing device 14 includes seven magnetic poles, namely, S3, N1, S2, N2, S1, N3, and S4. The alternate long and short dash line VL in FIG. 4 etc. is a straight line joining the center (O1) of the first developing roller 141 and the center (O2) of the second developing roller 142.

Among these magnetic poles, the magnetic pole S3 is arranged at a position substantially facing an upper end portion on the photoconductor drum 11 side of the screw auger 144, which is arranged close to the first developing roller 141. The magnetic pole S3 functions as a pole that performs pick-up. Specifically, the magnetic pole S3 attracts the developer 4 supplied from the screw auger 144 with a magnetic force to the outer peripheral surface of the sleeve 141A, and holds the developer 4. The magnetic pole N1 is a pole for control assistance, that is, a pole for assisting the control action performed by the passage control plate 145 on the developer 4 so that a magnetic brush having an appropriate size stands erect. The magnetic pole S2 is arranged at a position close to the second developing roller 142, and functions as a first transfer magnetic pole that generates a line of magnetic force for forming a path for transferring a part of the developer 4 transported by the first developing roller 141 to the outer peripheral surface side of the sleeve 142A of the second developing roller 142. The magnetic pole N2 is a transport pole that transports the developer remaining after the transfer to the second developing roller 142. The magnetic pole S1 is arranged at a position facing the downstream developing region E2 of the photoconductor drum 11, and functions as a development pole that causes the developer 4 to contribute to a developing step. The magnetic poles S4 and S3 function as poles that perform pick-off. Specifically, the magnetic poles S4 and S3 generate a repulsive magnetic force with the same polarity to separate the developer from the outer peripheral surface of the sleeve 141A after the developing step in the downstream developing region E2 is finished.

As illustrated in FIG. 4 etc., the magnet roller 142B of the second developing roller 142 in the developing device 14 includes seven magnetic poles, namely, N20, S10, N10, S20, N30, S30, and S40.

Among these magnetic poles, the magnetic pole N20 is arranged so as to substantially face the first transfer magnetic pole S2 in the first developing roller 141, and functions as a second transfer magnetic pole that generates a line of magnetic force for forming a path for transferring a part of the developer 4 transported by the first developing roller 141 to the outer peripheral surface side of the sleeve 142A of the second developing roller 142 in cooperation with the first transfer magnetic pole S2. The magnetic pole S10 is a transport pole that transports the developer transferred from the first developing roller 141. The magnetic pole N10 is arranged at a position facing the upstream developing region E1 of the photoconductor drum 11, and functions as a development pole that causes the developer 4 to contribute to the developing step. The magnetic poles S20 and N30 are transport poles that transport the developer after the developing step in the upstream developing region E1 is finished. The magnetic poles S30 and S40 function as poles that perform pick-off. Specifically, the magnetic poles S30 and S40 generate a repulsive magnetic field (line of magnetic force) with the same magnetism to separate the developer 4 from the outer peripheral surface of the sleeve 142A.

Description of Operation of Developing Device with Reference to Detailed Structure A basic operation of the developing device 14 will be described.

First, when the image forming apparatus 1 starts the operation of image formation, the sleeve 141A of the first developing roller 141, the sleeve 142A of the second developing roller 142, and the screw augers 143 and 144 in the developing device 14 start to rotate, and a developing voltage is supplied to each of the sleeves 141A and 142A.

Consequently, the two-component developer 4 contained in the storage chamber 140*a* of the housing 140 is transported in the two circulating transport paths 140*d* and 140*e* in the storage chamber 140*a* in particular directions while being stirred by the rotating screw augers 143 and 144 so that the two-component developer 4 is circulated as a whole. In this case, a non-magnetic toner in the developer 4 is sufficiently stirred with a magnetic carrier and subjected to triboelectrification, and electrostatically adheres to the surface of the carrier.

Figure 5:
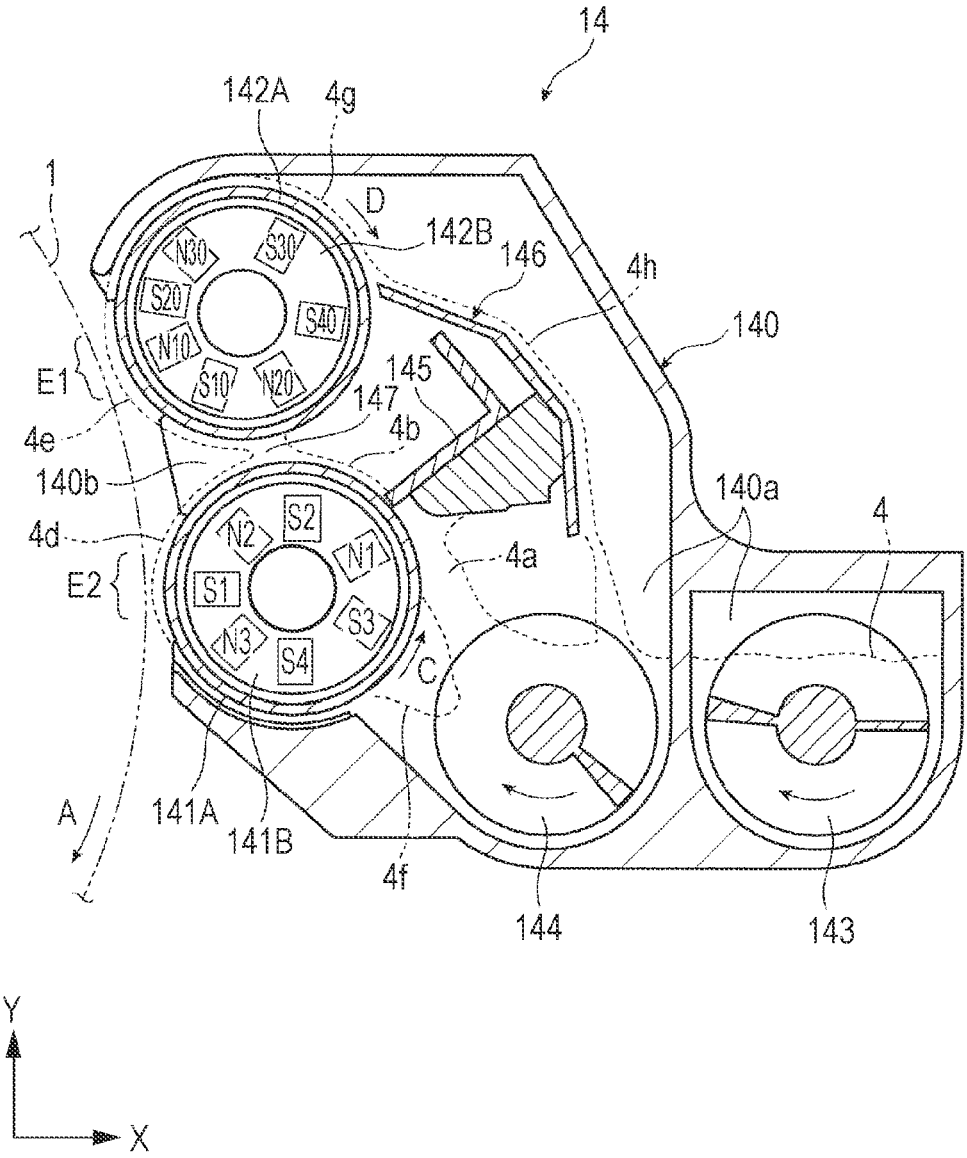
FIG. 5 is a view illustrating a basic operation of the developing device illustrated in FIG. 3.

Subsequently, as illustrated in FIG. 5, a portion 4*a* of the two-component developer 4 transported by the screw auger 144 arranged close to the first developing roller 141 is held on the outer peripheral surface of the sleeve 141A of the first developing roller 141 as a result of being adsorbed by a magnetic force. Specifically, a magnetic force (line of magnetic force) generated from the magnetic pole S3 of the magnet roller 141B reaches the outer peripheral surface of the rotating sleeve 141A, whereby the portion 4*a* of the developer 4 is held and supplied while forming a carrier-chain magnetic brush in which the magnetic carrier particles to which the charged non-magnetic toner adheres are connected to one another in the form of a chain.

Figure 6:
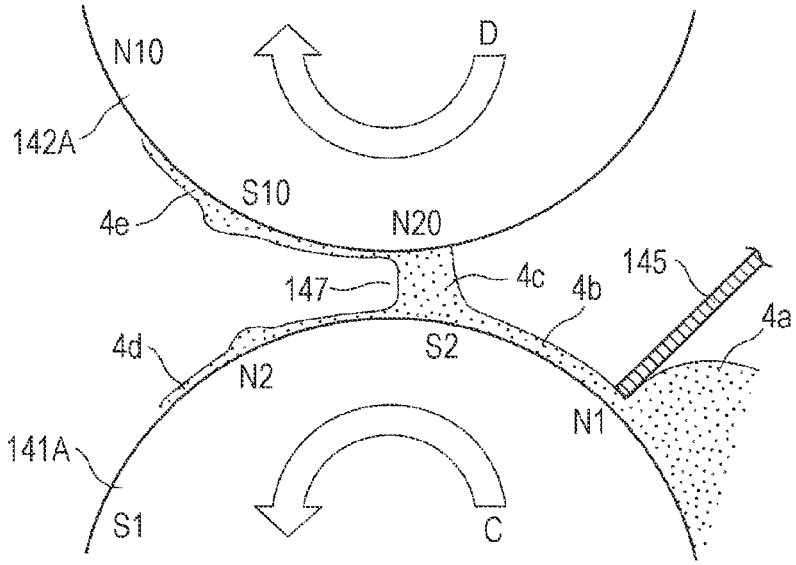
FIG. 6 is an enlarged schematic view illustrating a part of the operation of the developing device illustrated in FIG. 5.

Subsequently, as illustrated in FIGS. 5 and 6, in the course of transportation by the rotation of the sleeve 141A, a portion of the two-component developer 4*a* held by the sleeve 141A is blocked by the passage control plate 145 and a portion of the two-component developer 4*a* is allowed to pass. Specifically, the developer 4*a* reaching the passage control plate 145 forms a magnetic brush and is in a standing state while receiving a magnetic force of the magnetic pole N1 for control assistance. Thus, a portion of the developer 4*a* is blocked by the passage control plate 145, and a large portion of the developer 4*a* is returned to the storage chamber 140*a* side. On the other hand, when the remaining developer 4*b* passes through the gap formed between the sleeve 141A and the passage control plate 145, the passage of the developer 4*b* is controlled so that the developer 4*b* has a substantially uniform layer thickness (so that a constant amount of the developer 4*b* is transported).

Subsequently, as illustrated in FIG. 5, the developer 4*b* after being controlled by the passage control plate 145 reaches and then passes through the closest portion 147 between the first developing roller 141 and the second developing roller 142. In this case, when the developer 4*b* passes through a position slightly front of the closest portion 147, the developer 4*b* is transferred so that a portion of the developer 4*b* is moved from the first developing roller 141 to the second developing roller 142 along a transfer path formed of a magnetic brush formed by the first transfer magnetic pole S2 and the second transfer magnetic pole N20, which are respectively arranged in the first developing roller 141 and the second developing roller 142 so as to face each other. As a result, as illustrated in FIG. 5, the developer 4*b* is substantially divided into two parts and distributed onto the first developing roller 141 and the second developing roller 142 (developer 4*d* and developer 4*e*).

In this case, the developer 4*d* distributed onto the first developing roller 141 is transported while being held on the outer peripheral surface of the sleeve 141A rotating in the direction indicated by the arrow C by a magnetic force of the transport pole N2. When the developer 4*d* passes through the downstream developing region E2 of the photoconductor drum 11, the developer 4*d* receives a magnetic force of the development pole S1 and receives an action by the developing electric field due to the developing voltage. Accordingly, the toner in the magnetic brush of the developer 4*d* is reciprocated between the outer peripheral surface of the photoconductor drum 11 and the outer peripheral surface of the sleeve 141A and adheres to a latent image portion passing through the downstream developing region E2. Thus, the latent image portion is again developed subsequent to the developing step in the upstream developing region E1.

A developer 4*f* after passing through the downstream developing region E2 receives an action of a repulsive magnetic force formed between the magnetic poles S4 and S3 serving as separation poles, and is separated from the outer peripheral surface of the sleeve 141A and naturally falls to be returned to the storage chamber 140*a* of the housing 140.

The developer 4*e* transferred and distributed onto the second developing roller 142 is transported while being held on the outer peripheral surface of the sleeve 142A rotating in the direction indicated by the arrow D by a magnetic force of the transport pole S10. When the developer 4*e* passes through the upstream developing region E1 of the photoconductor drum 11, the developer 4*e* receives a magnetic force of the development pole N10 and receives an action by the developing electric field due to the developing voltage. Accordingly, the toner in the magnetic brush of the developer 4*e* is reciprocated between the outer peripheral surface of the photoconductor drum 11 and the outer peripheral surface of the sleeve 142A and adheres to a latent image portion passing through the upstream developing region E1, thereby developing the latent image portion.

A developer 4*g* after passing through the upstream developing region E1 is transported while being held on the outer peripheral surface of the sleeve 142A rotating in the direction indicated by the arrow D by a magnetic force of the transport poles S20 and N30, and is then separated from the outer peripheral surface of the sleeve 142A by a repulsive magnetic force formed between the magnetic poles S30 and S40 serving as separation poles. A developer 4*h* separated at this time is collected so as to be received by the recovery guiding plate 146, and is finally returned so as to be guided into the storage chamber 140*a* of the housing 140.

The development by the developing device 14 is performed as described above.

Characteristic Structure of Developing Device

In this developing device 14, the developer 4 is transferred between the sleeve 141A of the first developing roller, which is arranged close to the passage control plate 145, and the sleeve 142A of the second developing roller, which is arranged so as to face the sleeve 141A with a gap γ therebetween, through a transfer path formed by a magnetic force of the transfer magnetic poles S2 and N20, which are respectively arranged in the magnet rollers 141B and 142B arranged in the inner spaces of the sleeves 141A and 142A. In such a developing device, the following problem occurs.

Specifically, in this developing device 14, the layers of the developers 4*d* and 4*e* respectively held on the outer peripheral surfaces of the sleeves 141A and 142A are in an alternating sparse and dense state in the axial direction of each of the sleeves due to the influence of a magnetic field formed by the transfer magnetic poles S2 and N20. Consequently, stripe-like density unevenness may be generated in the rotation direction A of the photoconductor drum 11 on a toner image formed on the photoconductor drum 11 by the development.

Figure 10:
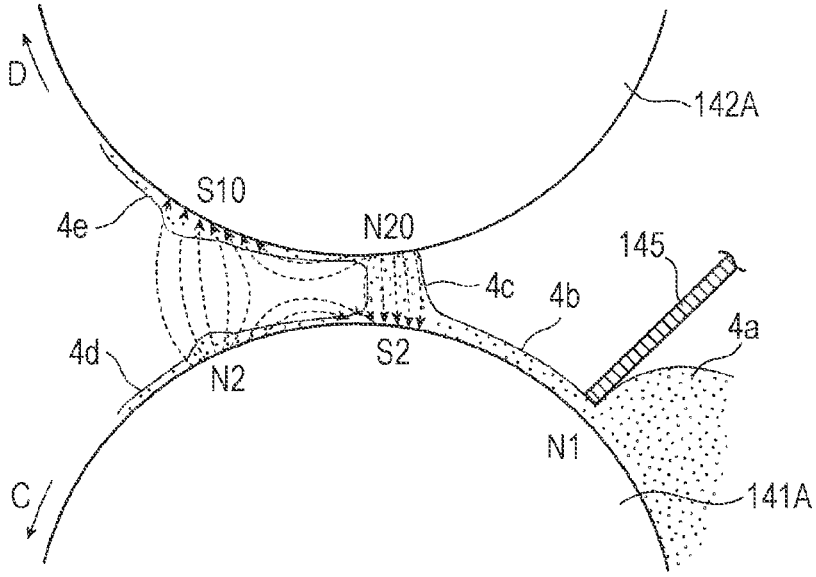
FIG. 10 is an enlarged schematic view illustrating the structure and the state of transfer magnetic poles in a developing device in the related art in which a developer is transferred between two developing rollers by a magnetic force of the transfer magnetic poles.

Specifically, first, the transfer path of the developer 4*c* formed between (the sleeve 141A of) the first developing roller 141 and (the sleeve 142A of) the second developing roller 142 is formed as follows. As schematically illustrated in FIG. 10, a magnetic carrier, which is a magnetic substance in the developer 4*c*, is magnetized along lines of magnetic force (the arrows indicated by the dotted lines) generated by the transfer magnetic poles S2 and N20, and is present so as to connect (fill a space between) the sleeves 141A and 142A. In this case, as schematically illustrated in FIG. 11, when the state of the developer 4*c* is viewed in the axial direction of each of the sleeves 141A and 142A (in the direction of coordinate axis Z), the transfer path of the developer has a structure in which the magnetized magnetic carrier particles are linked to each other substantially in the form of a column by a repulsive force (repellent force) due to the repulsion of the lines of magnetic force generated by the transfer magnetic poles S2 and N20.

Figure 11:
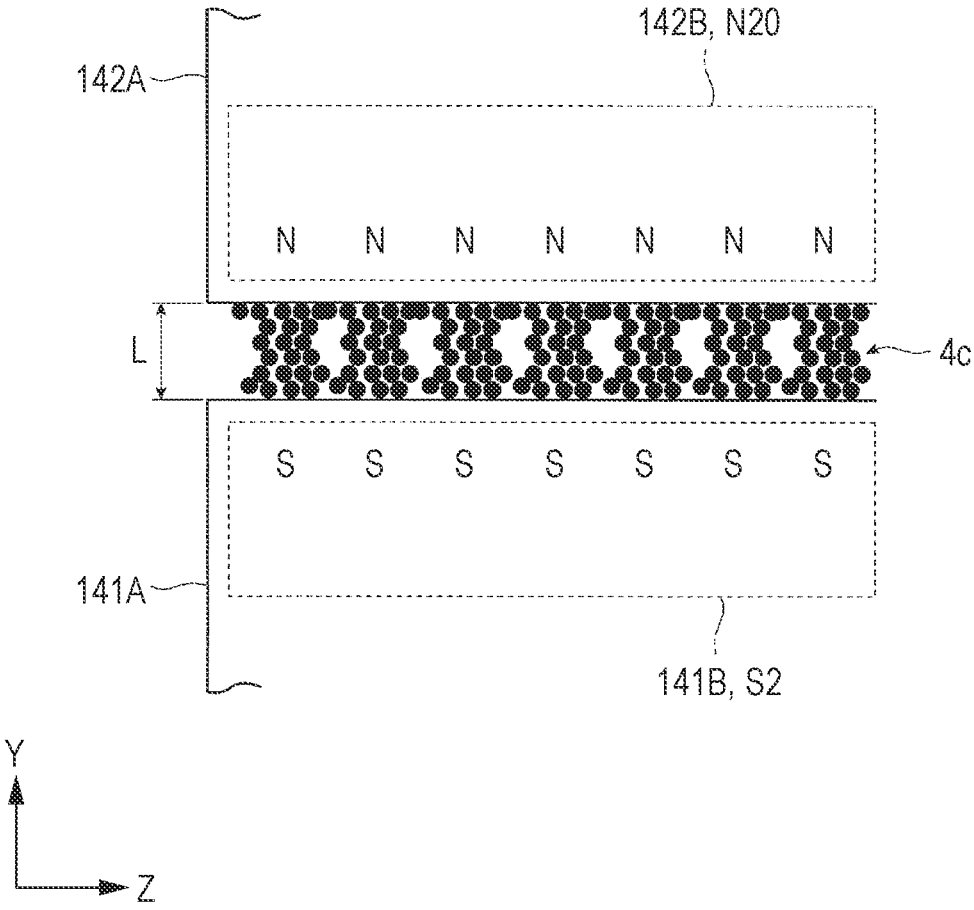
FIG. 11 is a view illustrating a state (an alternating sparse and dense state of a transfer path) when a transfer portion of the developer in FIG. 10 is viewed in an axial direction of sleeves.

However, when the magnetic field formed by the transfer magnetic poles S2 and N20 is excessively strong, as schematically illustrated in FIG. 11, the repulsive force in the transfer path of the developer also becomes strong, and, as a result, the transfer path is in an alternating sparse and dense state in the axial direction of each of the sleeves 141A and 142A. Consequently, the layer thickness of the developer held between the outer peripheral surfaces of the sleeves 141A and 142A becomes uneven. Accordingly, the developers 4*d* and 4*e* (FIG. 5) held on the outer peripheral surfaces of the sleeves 141A and 142A are also respectively transported to the developing regions E2 and E1 in the form of stripe-like unevenness in the rotation directions C and D of the sleeves 141A and 142A, and provided to respective developing steps.

It is believed that, as a result, stripe-like density unevenness is generated in the rotation direction A of the photoconductor drum 11 also on a toner image formed on the photoconductor drum 11 by being developed by the developers 4*d* and 4*e* having an uneven layer thickness and respectively transported by such sleeves 141A and 142A.

Figure 7:
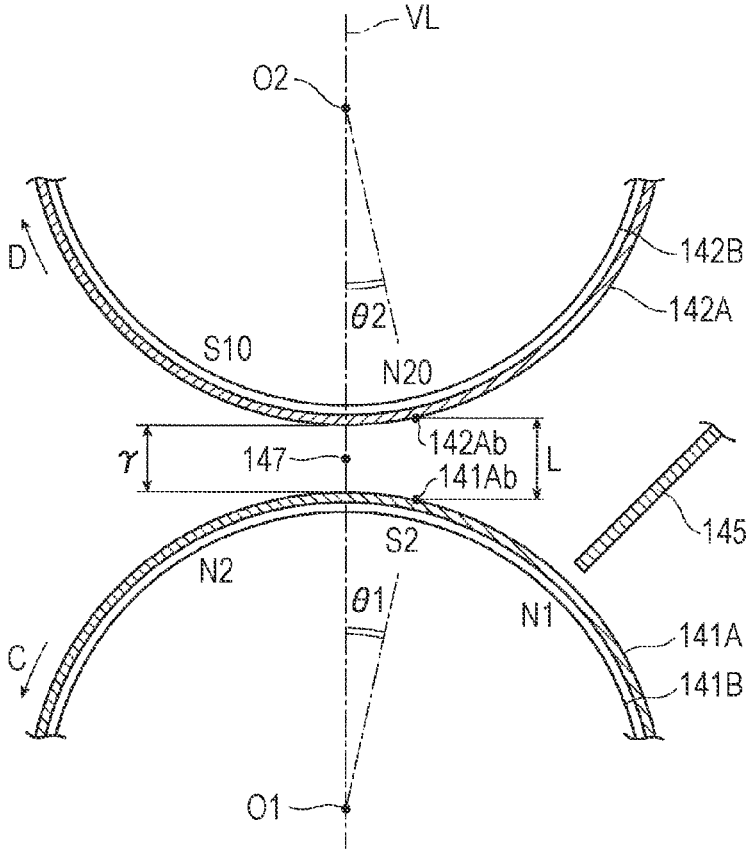
FIG. 7 is an enlarged view illustrating the structure of the relevant part of the developing device illustrated in FIG. 3 (FIG. 4)

To address this problem, as illustrated in FIG. 7, a value of $(B1 \times B2)/L^2$ in this developing device 14 is less than 400, or less than about 400, where L represents a distance (mm) between an outer peripheral surface portion 141Ab of the sleeve 141A of the first developing roller, the outer peripheral surface portion 141Ab facing the first transfer magnetic pole S2, and an outer peripheral surface portion 142Ab of the sleeve 142A of the second developing roller, the outer peripheral surface portion 142Ab facing the second transfer magnetic pole N20, B1 (mT) represents a maximum magnetic flux density of the first transfer magnetic pole S2 in a normal line direction on the outer peripheral surface of the sleeve 141A in the first developing roller, and B2 (mT) represents a maximum magnetic flux density of the second transfer magnetic pole N20 in a normal line direction on the outer peripheral surface of the sleeve 142A in the second developing roller.

In the developing device 14 having this structure, it is possible to suppress or prevent the problem that the layers of the developers 4*d* and 4*e* respectively held, during (and after) transfer, on the outer peripheral surface of the sleeve 141A of the first developing roller and on the outer peripheral surface of the sleeve 142A of the second developing roller are in an alternating sparse and dense state in the axial direction of each of the sleeves. As a result, it is possible to suppress the generation of stripe-like density unevenness in the rotation direction A of the photoconductor drum 11 on a toner image formed on the photoconductor drum 11 by being developed by the developers 4*d* and 4*e* respectively transported by the sleeves 141A and 142A.

The outer peripheral surface portion 141Ab of the sleeve 141A and the outer peripheral surface portion 142Ab of the sleeve 142A that define the distance L are determined as follows. For example, when a magnetic substance (e.g., an iron wire or an iron pin) is caused to approach each of the outer peripheral surfaces of the sleeves 141A and 142A where the first transfer magnetic pole S2 and the second transfer magnetic pole N20 are expected to be present, the substantially central positions where the magnetic force (attraction force) due to each of the magnetic poles most strongly acts on the magnetic substance are respectively determined as the outer peripheral surface portion 141Ab and the outer peripheral surface portion 142Ab. The distance L is determined by actually measuring the physical linear distance between the outer peripheral surface portion 141Ab of the sleeve 141A and the outer peripheral surface portion 142Ab of the sleeve 142A.

The distance L may be appropriately determined as long as the above relationship is satisfied. The distance L is preferably determined in the range of 3 mm or more and 5 mm or less. When the distance L is less than 3 mm, the developer (layer) 4*d* or 4*e* distributed and held on the developing roller 141 or 142 may cause a problem such as a layer disorder. On the other hand, when the distance L exceeds 5 mm, the formation of the transfer path by the developer (layer) 4*c* between the two developing rollers 141 and 142 may become unstable or in a defective state. The distance L may be adjusted by adjusting a distance γ between the sleeve 141A of the first developing roller 141 and the sleeve 142A of the second developing roller 142. Alternatively, the distance L may be adjusted by adjusting an angle θ1 formed by a straight line joining the center (O1) of the first developing roller 141 and (the center position of) the first transfer magnetic pole S2 and a straight line VL joining the center (O1) of the first developing roller 141 and the center (O2) of the second developing roller 142, and an angle θ2 formed by a straight line joining the center (O2) of the second developing roller 142 and (the center position of) the second transfer magnetic pole N20 and the straight line VL. Alternatively, the distance L may be adjusted by adjusting the distance γ and the angles θ1 and θ2. The distance L is equal to or larger than the distance γ between the sleeve 141A of the first developing roller 141 and the sleeve 142A of the second developing roller 142 ($L \geq \gamma$).

The maximum magnetic flux density B1 of the first transfer magnetic pole S2 and the maximum magnetic flux density B2 of the second transfer magnetic pole N20 are measured as follows. For example, the first developing roller 141 and the second developing roller 142 detached from the developing device 14 are separately fixed to a jig so that the sleeve 141A of the first developing roller 141 and the sleeve 142A of the second developing roller 142 do not rotate. A magnetic flux density measuring device (such as a probe of a gauss meter) is brought into contact with the outer peripheral surface of each of the sleeves, and the magnet rollers 141B and 142B are then rotated by 360 degrees in the sleeves, thereby measuring the magnetic flux density distribution of each of the transfer magnetic poles in a normal line direction etc.

The maximum magnetic flux densities B1 and B2 of the transfer magnetic poles S2 and N20 may be appropriately determined as long as the above relationship is satisfied. The maximum magnetic flux densities B1 and B2 are each preferably set to 45 mT or more and 90 mT or less. Incidentally, if one of the maximum magnetic flux densities B1 and B2 is set to be excessively small (or large), it is necessary to set the other maximum magnetic flux density to be excessively large (or small). However, if the maximum magnetic flux densities are set to have a significantly unbalanced relationship in this manner, the amounts of developers 4*d* and 4*e* held (the amounts of flow of developers 4*d* and 4*e*) become significantly different from each other. Accordingly, it is appropriate to determine the maximum magnetic flux densities B1 and B2 while considering this undesirable point. The magnetic flux densities B1 and B2 may be set (adjusted) by adjusting the magnetic forces of the first transfer magnetic pole S2 and the second transfer magnetic pole N20 in the stage of the production (design) of the developing rollers.

Evaluation Test

An evaluation test conducted by using this developing device 14 will be described below.

In the evaluation test, the distance L and the maximum magnetic flux densities B1 and B2 in the developing device 14 are set as shown in FIG. 8. A test image is formed by an image forming apparatus 1 including the developing device 14 of each test number, and the generation of stripe-like density unevenness is examined in each of the resulting images. The distance L is adjusted by adjusting the distance γ between two developing rollers 141 and 142. The magnetic flux densities B1 and B2 are adjusted by selecting, as two transfer magnetic poles, magnetic poles having different magnetic forces. The magnetic flux density is measured using a gauss meter (MFD-04, produced by Clover Engineering Co., Ltd.). The test is performed in an environment at a temperature of 22° C. and at a relative humidity of 55% RH.

A developing device including a first developing roller 141 having a sleeve 141A with an outer diameter of 25 mm and a second developing roller 142 having a sleeve 142A with an outer diameter of 25 mm is used as the developing device 14. The distances α and β are each set to a value in the range of 200 to 300 μm. A passage control plate 145 is arranged close to the outer peripheral surface of the sleeve 141A of the first developing roller 141 with a gap of 800 μm therebetween. The sleeve 141A is rotated in the rotation direction C at a rate of 634 mm/sec. The sleeve 142A is rotated in the rotation direction D at a rate of 950 mm/sec.

A two-component developer containing a non-magnetic toner having an average particle diameter of 3.8 μm and a magnetic carrier having an average particle diameter of 25 μm is used as the developer 4. A photoconductor drum having an organic photosensitive layer thereon and an outer diameter of 84 mm is used as the photoconductor drum 11, and is rotated at a rate of 528 mm/sec. A solid image is formed as a test image. The test image is finally formed on plain paper.

Each of the images is visually observed to examine the generation of stripe-like density unevenness in the rotation direction A of the photoconductor drum 11. The evaluation is conducted on the basis the criteria below. The results are shown in the table in FIG. 8. The value of $(B1 \times B2)/L^2$ is also shown in the table in FIG. 8.

○: No stripe-like density unevenness is visually observed.

Δ: Stripe-like density unevenness is slightly visually observed.

x: Stripe-like density unevenness is clearly visually observed.

Figure 9:
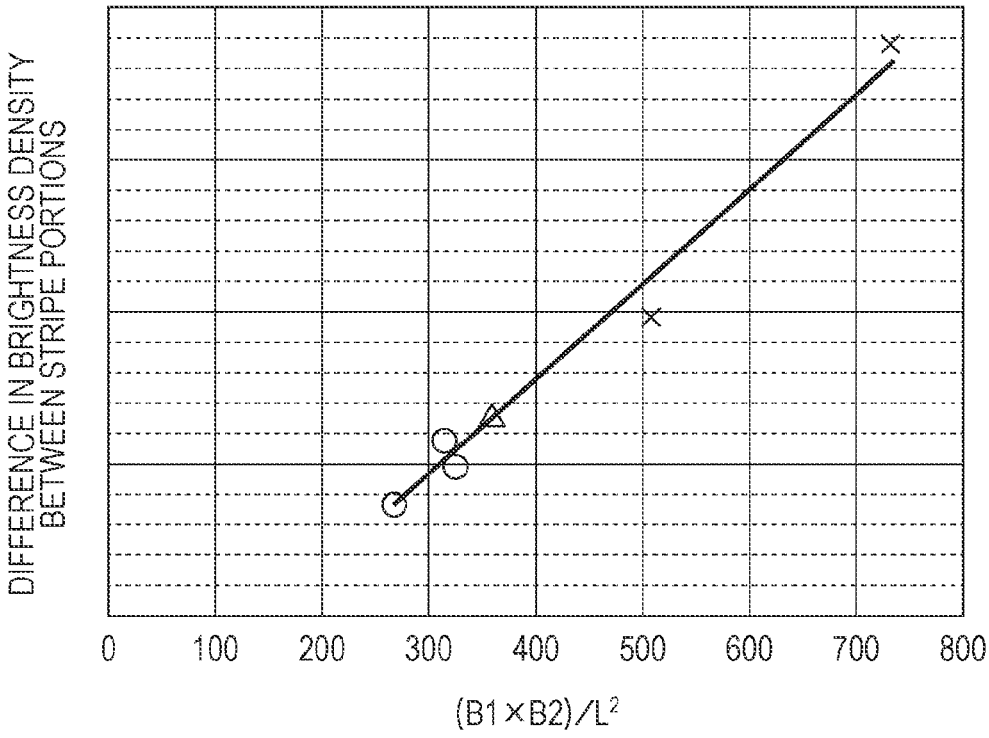
FIG. 9 is a graph showing the results of an evaluation test.

A difference in a brightness density between stripe portions (portions of the stripe-like density unevenness) of each of the images is measured using a high-precision color scanner (ES-8500, produced by Seiko Epson Corporation). The results are shown in the graph of FIG. 9 where the horizontal axis represents the value of $(B1 \times B2)/L^2$. The difference in the brightness density between stripe portions is not expressed in units because the difference is a value obtained by processing with software. However, for example, the difference in the brightness density between stripe portions is a value proportional to a generally adopted unit for the difference in the brightness (ΔL*).

The results in FIG. 8 show that the evaluation results vary depending on the value of $(B1 \times B2)/L^2$. The results in FIG. 9 show that there is a correlation between the value of $(B1 \times B2)/L^2$ and the difference in the brightness density between stripe portions.

According to the above results, it is found that the generation of stripe-like density unevenness is suppressed by at least controlling the value of $(B1 \times B2)/L^2$ to less than 400, or less than about 400. Furthermore, it is found that the generation of stripe-like density unevenness is prevented by controlling the value of $(B1 \times B2)/L^2$ to less than 350. When the value of $(B1 \times B2)/L^2$ is 202 or less (in the cases of test Nos. 1, 2, and 4), even the transfer path cannot be formed. From this standpoint, the lower limit of the value of $(B1 \times B2)/L^2$ may be set to 250 or more, for example.

Other Exemplary Embodiments

In the first exemplary embodiment, a description has been made of an example in which the transfer magnetic pole of the first developing roller 141 is the S-pole, and the transfer magnetic pole of the second developing roller 142 of the developing device 14 is the N-pole. Alternatively, the transfer magnetic poles may have the opposite magnetic pole relationship. The number of magnetic poles of each of the magnet roller 141B of the first developing roller 141 and the magnet roller 142B of second developing roller 142 is not limited to 7.

The developing device 14 may include three or more developing rollers. In such a case, a developing roller that is arranged close to the passage control plate 145 is treated as a first developing roller, and a developing roller that is arranged adjacent to the first developing roller is treated as a second developing roller. It is sufficient that these developing rollers are set so that the value of $(B1 \times B2)/L^2$ is less than 400, or less than about 400. Regarding other developing rollers, the value of $(B1 \times B2)/L^2$ may not be necessarily less than 400, or less than about 400.

The structure, such as the form, of the image forming apparatus 1 including the developing device 14 according to an exemplary embodiment of the present invention is not particularly limited as long as the developing device 14 is used. The image forming apparatus 1 may be formed as an image forming apparatus having a known structure. For example, the image forming apparatus 1 may include a belt-shaped photoconductor instead of the photoconductor drum 11.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a cylindrical first developer-transporting member having an outer peripheral surface for holding and transporting a developer that exhibits magnetism, the first developer-transporting member being arranged so as to rotate with a gap between the first developer-transporting member and a rotatable latent image-carrying member;

a first magnet member in which a plurality of magnetic poles extending in an axial direction of the first developer-transporting member are arranged at intervals in a rotation direction of the first developer-transporting member, the first magnet member being fixed in an inner space of the first developer-transporting member;

a cylindrical second developer-transporting member having an outer peripheral surface for holding and transporting a developer that exhibits magnetism, the second developer-transporting member being arranged so as to rotate with gaps between the second developer-transporting member and the latent image-carrying member and between the second developer-transporting member and the outer peripheral surface of the first developer-transporting member;

a second magnet member in which a plurality of magnetic poles extending in an axial direction of the second developer-transporting member are arranged at intervals in a rotation direction of the second developer-transporting member, the second magnet member being fixed in an inner space of the second developer-transporting member; and a passage control member that controls a passage of a part of the developer held on the outer peripheral surface of the first developer-transporting member to maintain a particular amount of the developer transported, the passage control member being arranged with a gap between the passage control member and the outer peripheral surface of the first developer-transporting member and facing the outer peripheral surface of the first developer-transporting member in the axial direction of the first developer-transporting member, wherein the first magnet member and the second magnet member respectively include a first transfer magnetic pole and a second transfer magnetic pole that have different polarities and that generate a magnetic force functioning as a path for transferring the developer from the first developer-transporting member to the second developer-transporting member, the first transfer magnetic pole and the second transfer magnetic pole being located at positions corresponding to portions where the first developer-transporting member and the second developer-transporting member come close to each other, and $(B1 \times B2)/L^2$ is less than about 400, where L represents a distance (mm) between a first outer peripheral surface portion of the first developer-transporting member, the first outer peripheral surface portion facing the first transfer magnetic pole, and a second outer peripheral surface portion of the second developer-transporting member, the second outer peripheral surface portion facing the second transfer magnetic pole, B1 (mT) represents a maximum magnetic flux density of the first transfer magnetic pole in a normal line direction on the outer peripheral surface of the first developer-transporting member, and B2 (mT) represents a maximum magnetic flux density of the second transfer magnetic pole in a normal line direction on the outer peripheral surface of the second developer-transporting member, wherein the maximum magnetic flux densities B1 and B2 are each preferably set to 45 mT or more and 90 mT or less.

2. An image forming apparatus comprising:

a rotatable latent image-carrying member; and a developing device that develops a latent image formed on the latent image-carrying member with a developer, wherein the developing device is the developing device according to claim 1.

* * * * *